US010198023B2

(12) United States Patent
Yoshino et al.

(10) Patent No.: US 10,198,023 B2
(45) Date of Patent: Feb. 5, 2019

(54) REFERENCE VOLTAGE GENERATOR

(71) Applicant: ABLIC Inc., Chiba-shi, Chiba (JP)

(72) Inventors: Hideo Yoshino, Chiba (JP); Masahiro Hatakenaka, Chiba (JP)

(73) Assignee: ABLIC INC., Chiba (JP)

( * ) Notice: Subject to any disclaimer, the term of this patent is extended or adjusted under 35 U.S.C. 154(b) by 0 days.

(21) Appl. No.: 15/940,010

(22) Filed: Mar. 29, 2018

(65) Prior Publication Data

US 2018/0284833 A1 Oct. 4, 2018

(30) Foreign Application Priority Data

Mar. 31, 2017 (JP) ..... 2017-072217

(51) Int. Cl.
*G05F 3/26* (2006.01)

(52) U.S. Cl.
CPC ..... *G05F 3/262* (2013.01)

(58) Field of Classification Search
CPC ..... G05F 3/00; G05F 3/02; G05F 3/08; G05F 3/10; G05F 3/16; G05F 3/20; G05F 3/22; G05F 3/24; G05F 3/26; G05F 3/262; G05F 3/30; G05F 3/185
See application file for complete search history.

(56) References Cited

U.S. PATENT DOCUMENTS 4,438,353 A * 3/1984 Sano ..... H03K 19/091 326/100
5,373,226 A * 12/1994 Kimura ..... G05F 3/245 323/313
5,563,898 A * 10/1996 Ikeuchi ..... H01S 5/042 372/38.07
5,780,904 A * 7/1998 Konishi ..... G05F 3/262 257/348
6,677,810 B2 * 1/2004 Fukui ..... G05F 3/262 323/315
7,224,208 B2 * 5/2007 Matsushita ..... G05F 1/56 323/313
2003/0227322 A1 12/2003 Ozoe
2010/0171732 A1 * 7/2010 Miyazaki ..... G05F 3/30 345/211
2011/0121870 A1 * 5/2011 Morino ..... H03K 17/22 327/143

FOREIGN PATENT DOCUMENTS

JP 2004-13584 A 1/2004

* cited by examiner

*Primary Examiner* — Adolf D Berhane
(74) *Attorney, Agent, or Firm* — Brinks Gilson & Lione

(57) ABSTRACT

A reference voltage generator is constructed to be equipped with a first constant current circuit which outputs a first constant current with respect to an input voltage, a second constant current circuit which outputs a second constant current, and a voltage generation circuit which generates a voltage based on an input current, and to take a current based on the first constant current and the second constant current as an input current of the voltage generation circuit and output a reference voltage from the voltage generation circuit.

12 Claims, 12 Drawing Sheets

REFERENCE VOLTAGE GENERATOR

RELATED APPLICATIONS

This application claims priority under 35 U.S.C. § 119 to Japanese Patent Application No. 2017-072217 filed on Mar. 31, 2017, the entire content of which is hereby incorporated by reference.

BACKGROUND OF THE INVENTION

Field of the Invention

The present invention relates to a reference voltage generator.

Description of the Related Art

With the coming spread of IoT, an operating temperature range of an IC tends to expand as the IC is arranged in various products. It has thus been desired that in an IC having a reference voltage generator, a fluctuation in a reference voltage supplied from the reference voltage generator is small enough to suppress a malfunction.

When the temperature reaches high exceeding a certain temperature between 120° C. and 150° C., it has been known that in an IC formed in a semiconductor substrate a PN-junction leak current generated at a parasitic diode formed of P-type and N-type diffusion layers normally becomes remarkable and thereby affects the desired circuit operation. Hence, countermeasures against the increase of the PN-junction leak current have been required. Width of the temperature range is relatively wide because the influence given by a leak current differs depending on a circuit. Then, the temperate at which the PN-junction leak current begins to affect the circuit will hereinafter be called a leak current emerging temperature and denoted by a symbol LCET.

There has been disclosed in, for example, Japanese Patent Application Laid-Open No. 2004-13584, a technology for a bandgap reference circuit in which in order to suppress a change in a reference voltage caused by the PN-junction leak current, which is generated at a high temperature in a diffusion layer of a MOS transistor, flowing into a reference voltage generator, a dummy diffusion layer having the same leak current characteristic as that of a parasitic diode is provided within the reference voltage generator to suppress a fluctuation in the reference voltage.

SUMMARY OF THE INVENTION

However, in the related art reference voltage generator of Japanese Patent Application Laid-Open No. 2004-13584, the influence of the PN-junction leak current under the high temperature can be suppressed, but a small nonlinear characteristic relative to the temperature that a circuit element such as a diode in the reference voltage generator has cannot be reduced, thereby resulting in the generation of a fluctuation in the reference voltage based on the nonlinear characteristic of the circuit element. It is hence difficult to apply the reference voltage generator to an IC required to suppress a fluctuation in the reference voltage in a wide operating temperature range.

In view of above, the present invention aims to provide a reference voltage generator which suppresses a fluctuation in a reference voltage in an entire operating temperature range.

A reference voltage generator according to an embodiment of the present invention has the following configuration.

That is, there is provided a reference voltage generator including a first constant current circuit configured to output a first constant current with respect to an input voltage, a second constant current circuit configured to output a second constant current with respect to the input voltage, and a voltage generation circuit configured to output a reference voltage based on the first constant current and the second constant current, and configured to supply the reference voltage.

According to a reference voltage generator according to an embodiment of the present invention, in a reference voltage supplied from a reference voltage generator, a fluctuation on temperature which is based on nonlinearity relative to the temperature of each circuit element is suppressed by adjusting temperature coefficients of a first constant current circuit at a temperature lower than or equal to a leak current emerging temperature. Further, at a temperature higher than or equal to the leak current emerging temperature in which it is difficult for the first constant current circuit and the voltage generation circuit to relax nonlinearity relative to the temperature of each element, a reference voltage determined by a second constant current circuit and the voltage generation circuit is supplied to suppress a fluctuation in the reference voltage.

Thus, it is possible to suppress a fluctuation in the reference voltage supplied from the reference voltage generator in the entire operating temperature range.

DETAILED DESCRIPTION OF THE EMBODIMENTS

Embodiments of the present invention will hereinafter be described with reference to the accompanying drawings.

Figure 1:
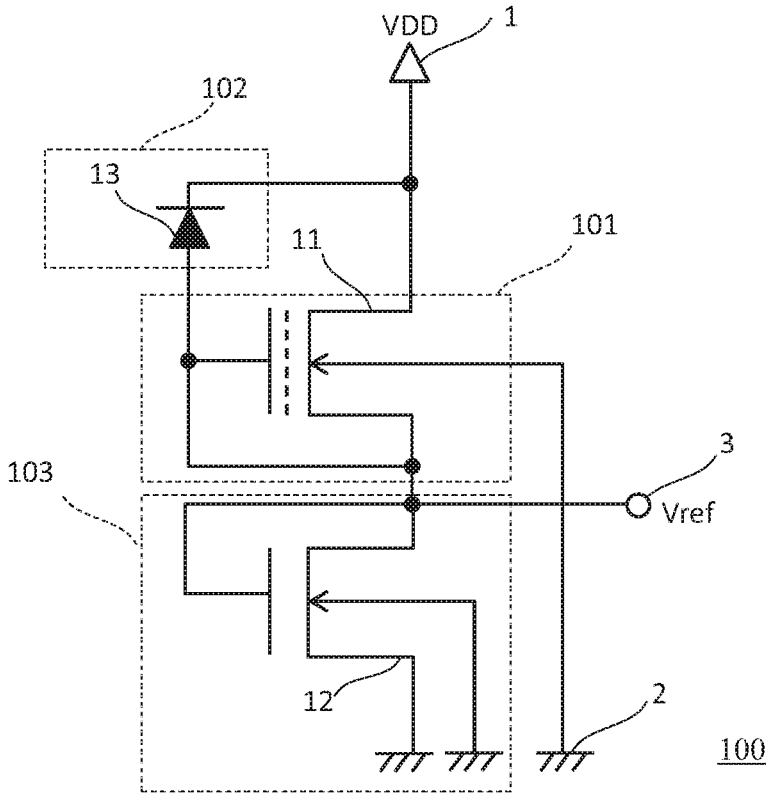
FIG. 1 is a circuit diagram illustrating a reference voltage generator according to a first embodiment of the present invention.

FIG. 1 is a circuit diagram illustrating a reference voltage generator 100 according to a first embodiment of the present invention.

The reference voltage generator 100 according to the first embodiment is equipped with a first constant current circuit 101, a second constant current circuit 102, and a voltage generation circuit 103. The reference voltage generator 100 is a device in which these circuits are formed in a P-type semiconductor substrate as will be described later.

The first constant current circuit 101 connected to a power supply terminal 1 and supplied with a power supply voltage VDD outputs a first constant current VDD-independent of the voltage generation circuit 103. Further, the second constant current circuit 102 connected to the power supply terminal 1 and supplied with the power supply voltage VDD outputs a second constant current VDD-independent of the voltage generation circuit 103. The voltage generation circuit 103 provided with the first constant current and the second constant current outputs a reference voltage Vref based on the first constant current and the second constant current to a reference voltage terminal 3.

In the first embodiment, the first constant current circuit 101 is constructed from a depletion type NMOS transistor 11. The depletion type NMOS transistor 11 has a gate and a source connected to the reference voltage terminal 3, a drain connected to the power supply terminal 1, and a backgate connected to a ground terminal 2. The second constant current circuit is constructed from a current adjusting diode 13 using a PN junction. The current adjusting diode 13 has an anode connected to the reference voltage terminal 3 and a cathode connected to the power supply terminal 1. The voltage generation circuit 103 is constructed from an enhancement type NMOS transistor 12. The enhancement type NMOS transistor 12 has a gate and a drain connected to the reference voltage terminal 3, and a source and a backgate connected to the ground terminal 2.

A description will next be made for the circuit operation of the reference voltage generator 100 illustrated in FIG. 1. The depletion type NMOS transistor 11 which constructs the first constant current circuit 101 has a first threshold voltage VTD and first mutual conductance gmD (at non-saturation operation). A drain current ID of the depletion type NMOS transistor 11 indicates such voltage-current characteristics and is given by the following equation (1), and a gate-to-source voltage VG thereof is 0V. The drain current ID hence becomes a saturation drain current which depends on the first threshold voltage VTD and does not depend on a drain voltage. That is, the saturation drain current is supplied from the source and becomes an output current of the first constant current circuit 101. In the following equation (1), VG is the gate-to-source voltage of the depletion type NMOS transistor 11.

$$ID = 1/2 \cdot gmD \cdot (VG - VTD)^2 = 1/2 \cdot gmD \cdot (|VTD|)^2 \quad (1)$$

The current adjusting diode 13 constructed from a PN junction diode which forms the second constant current circuit 102 has a forward voltage Vf given by the following equation (2). This is also called a diffusion potential and expressed by a Boltzmann constant k, a temperature T, an electron charge q, an impurity concentration Na of a P-type region, an impurity concentration Nd of an N-type region, and an intrinsic carrier density $n_i$ as follows:

$$Vf = kT/q \cdot \ln(Na \cdot Nd/ni2) \quad (2)$$

Further, since a high voltage is applied to the cathode of the current adjusting diode 13 from the power supply terminal 1, the current adjusting diode 13 outputs an reverse saturation current IS given by the following equation (3) from its anode. That is, the reverse saturation current becomes the output current of the second constant current circuit 102. In the following equation (3), Dn is a diffusion constant of an electron, Dp is a diffusion constant of a hole, Ln is a diffusion length of the electron, and Dp is a diffusion length of the hole. Further, $n_p$ is a minority carrier density of a P-type region, and $p_n$ is a minority carrier density of an N-type region. Since they are in inverse proportion to the impurity densities Na and Nd serving as majority carriers, IS becomes low where Vf is high, whereas IS becomes high where Vf is low.

$$IS = Dn \cdot np/Ln + Dp \cdot pn/Lp \quad (3)$$

The enhancement type NMOS transistor 12 which constructs the voltage generation circuit 103 has a second threshold voltage VTE and second mutual conductance gmE (at non-saturation operation). As to a drain current IE of the enhancement type NMOS transistor 12, the voltage of the gate thereof connected to the drain thereof coincides with the reference voltage Vref. Thus, as given by the following equation (4), the drain current IE depends on the second threshold voltage VTE and the reference voltage Vref and becomes a current similar to the forward characteristics of the diode with respect to the reference voltage Vref.

$$IE = 1/2 \cdot gmE \cdot (VG - VTE)^2 = 1/2 \cdot gmE \cdot (Vref - VTE)^2 \quad (4)$$

As described above, the reference voltage Vref is led with ID of the equation (1) and IS of the equation (3) being equal to IE of the equation (4). It is however possible to ignore the influence of the reverse saturation current IS at a temperature lower than or equal to LCET being a leak current emerging temperature. Hence, the reference voltage Vref is given by the following equation (5):

$$Vref = VTE + (gmD/gmE)^{1/2} |VTD| \quad (5)$$

On the other hand, the influence of the PN-junction leak current of a parasitic diode, which exponentially increases with a rise in temperature, and at the same time, an reverse saturation current IS of a current adjusting diode, which is larger than the PN-junction leak current, become remarkable at a temperature higher than or equal to LCET. Such a Vref component as given by the following equation (6) is accordingly added to the equation (5) through the equations (3) and (4). Here, ISp is the PN-junction leak current of the parasitic diode.

$$Vref = VTE + \{2IS - ISp\}/gmE)^{1/2} \quad (6)$$

Figure 2:
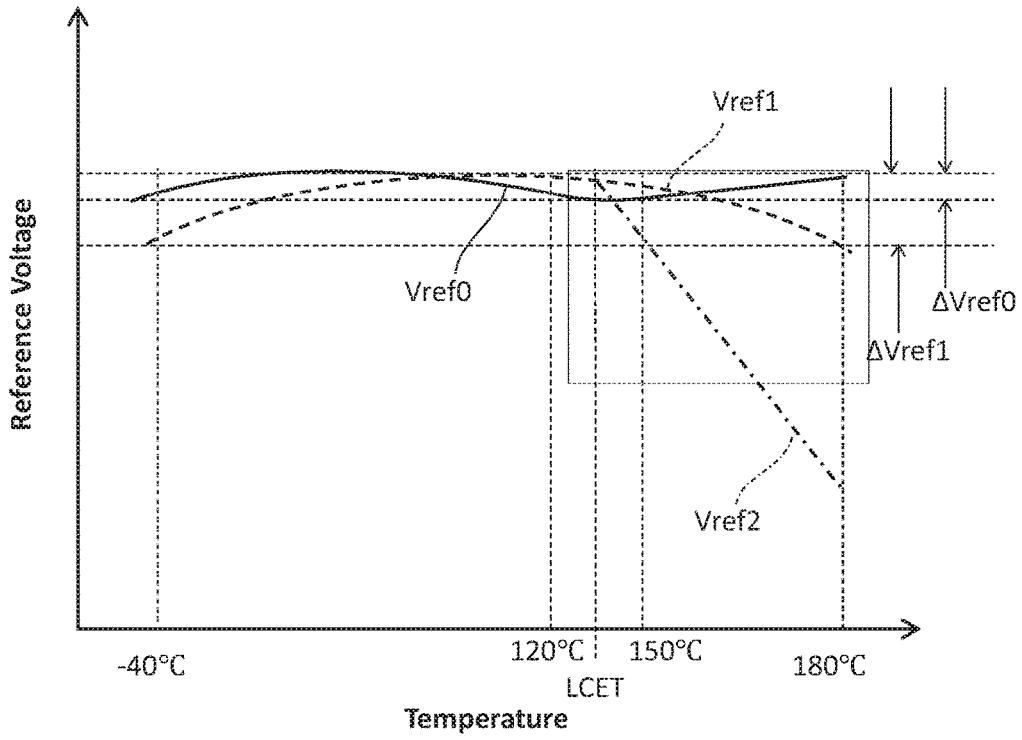
FIG. 2 is a diagram illustrating temperature dependency of a reference voltage supplied by the reference voltage generator according to the first embodiment.

FIG. 2 is a graph illustrating temperature dependency of a reference voltage where an entire operating temperature range is set from −40° C. to 180° C. in the first embodiment. Here, the entire operating temperature range is divided into two regions in which a first temperature range is set from −40° C. to LCET, and a second temperature range is set from LCET to 180° C. Further, Vref0 denotes a change in the reference voltage respect to a temperature change in the first embodiment, and Vref1 and Vref2 respectively express the manner of a change in the reference voltage respect to a temperature change in the related art. Vref1 expresses where the PN-junction leak current of the parasitic diode is absent, and Vref2 expresses where the PN-junction leak current of the parasitic diode is remarkable.

In FIG. 2, the reference voltage Vref0 in the first temperature range indicates a characteristic based on the equation (5). An adjustment of this characteristic is performed by appropriately changing gmD/gmE. On the other hand, the reference voltage Vref0 in the second temperature range, which is higher than or equal to LCET becomes a characteristic based on the equation (6), which is different from that in the first temperature range. An adjustment of the characteristic in this temperature range is performed by changing a diode area and the like. The difference between the characteristic in the first temperature range and the characteristic in the second temperature range is attributable to the difference between the characteristics of the first constant current circuit 101 and the second constant current circuit 102. This adjustment is not performed by switching the circuits with a switch or the like. That is, since the reference voltage component based on the equation (5) is more dominant than the reference voltage component based on the equation (6) in the first temperature range, the total Vref depends greatly on the equation (5). Further, since the reference voltage component based on the equation (6) makes up for a reduction in the reference voltage component based on the equation (5) in the second temperature range, the influence of the equation (6) on the total Vref becomes large. Accordingly LCET approximately becomes an inflection point on a curve indicative of the reference voltage Vref0.

Here, in order to clarify the effects of the embodiment, they will be described by comparison with problems in the reference voltage generator according to the related art.

Figure 8:
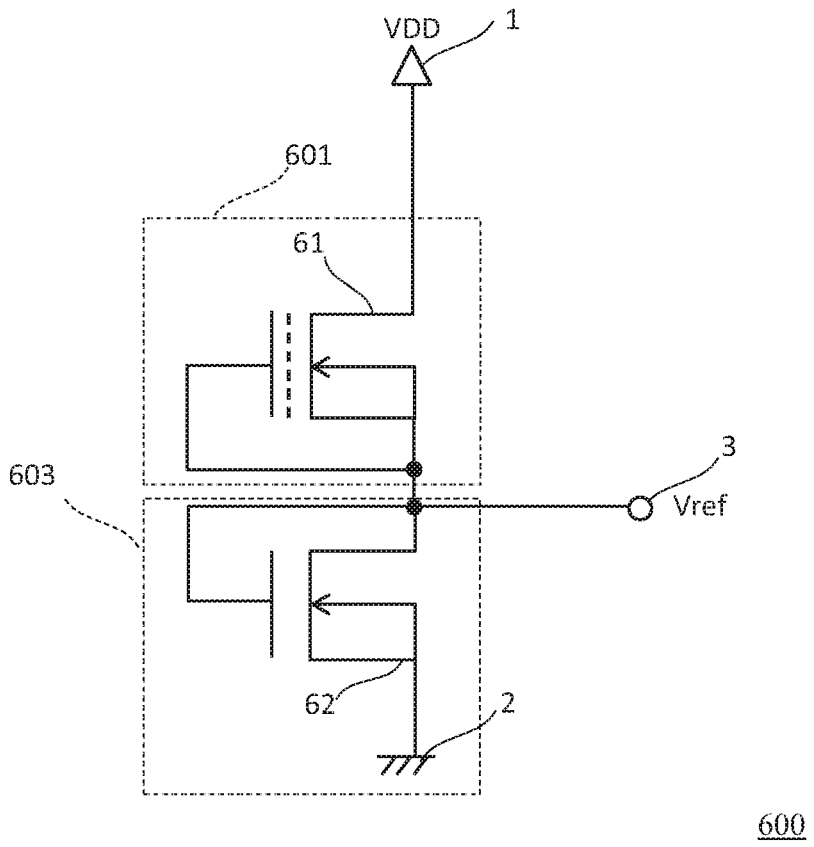
FIG.8 Prior Art
FIG. 8 is a circuit diagram illustrating a reference voltage generator according to a related art.

A reference voltage supplied from a related art reference voltage generator 600 constructed from only a first constant current circuit 601 and a voltage generation circuit 603 both illustrated in FIG. 8 becomes a characteristic of Vref1 indicated by a dotted line in FIG. 2, based only on the equation (5). At this time, gmD/gmE is adjusted in such a manner that an approximate primary temperature coefficient (term represented by a primary expression relative to the temperature in an approximation equation) of Vref1 relative to the temperature between −40° C. and 180° C. becomes zero. That is, Vref1 at −40° C. and Vref1 at 180° C. become approximately the same value, and hence the inclination of a straight line connecting between these becomes almost zero. However, Vref1 does not reach a linear characteristic completely due to the influence of a nonlinear characteristic relative to the temperature of a circuit element. Further, the technology of Japanese Patent Application Laid-Open No. 2004-13584 resides in that in order to prevent such Vref2 as indicated by a one-dot chain line in FIG. 2 from being abruptly reduced due to the influence of the PN-junction leak current of the parasitic diode at a high temperature, the diode constructed from the dummy diffusion layer is provided to eliminate the influence of the parasitic diode. Since, however, the aforementioned small nonlinear characteristic relative to the temperature of the circuit element remains as it is, it is not possible to suppress a fluctuation in the reference voltage ΔVref1 in the reference voltage Vref1 for that at −40° C. to 180° C.

While on the other hand, the first embodiment of the present invention is constructed to divide the temperature range into two in consideration of the nonlinear characteristic held by such a circuit element and naturally switch the constant current circuits in the respective temperature ranges thereby to reduce the fluctuation in the reference voltage from ΔVref1 to ΔVref0 in the entire operating temperature range. That is, Vref0 at the temperature from −40° C. to LCET is adjusted in such a manner that an approximate primary temperature coefficient at Vref0 becomes zero in this temperature range on the basis of the equation (5). Specifically, the influence of nonlinear characteristics at −40° C. to LCET is minimized by adjusting the approximate primary temperature coefficient to be a negative value in the temperature range of −40° C. to 180° C. Further, a portion of Vref0, which is reduced in accordance with a negative approximate primary temperature coefficient, based on the equation (5) at the temperature from LCET to 180° C., has a positive temperature coefficient. Hence, the reduction in Vref0 is compensated by the reference voltage component of the equation (6) which becomes prominent in the range of such a temperature. By doing like this, the fluctuation in the reference voltage can be more suppressed than in the related art.

A description will next be made about the details of the adjustment of Vref in the temperature range from −40° C. to LCET. First, when the PN-junction leak current at the high temperature by the parasitic diode is not taken into consideration, the reference voltage Vref indicates the characteristic of the equation (5) based on the characteristics of the depletion type NMOS transistor and the enhancement type NMOS transistor in a wider temperature range.

Figure 9:
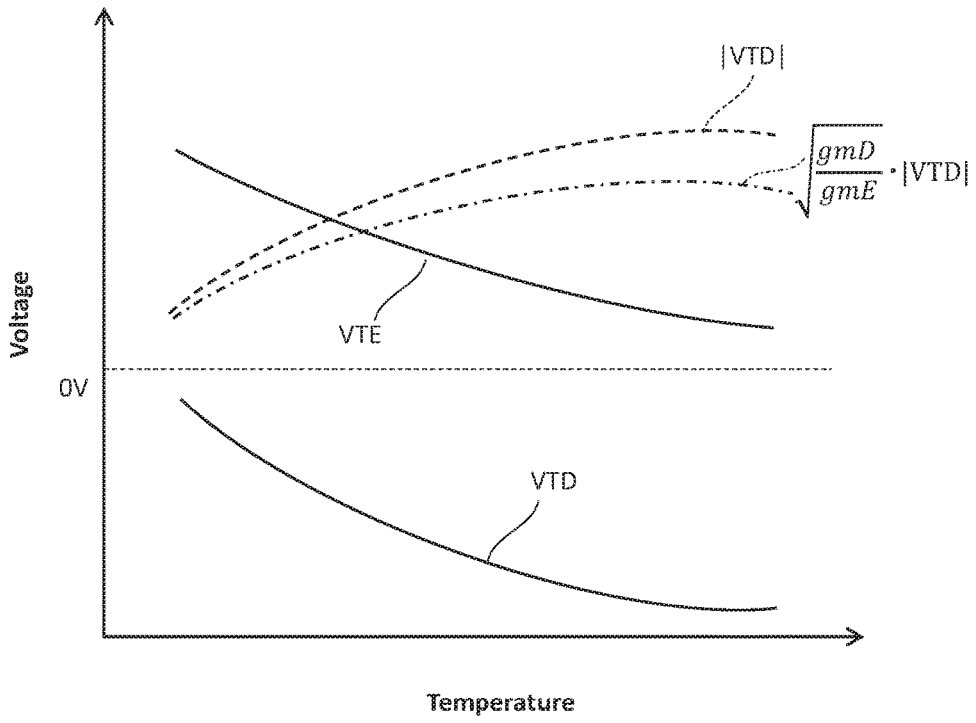
FIG. 9 is a diagram illustrating temperature dependency of a circuit element.

FIG. 9 illustrates temperature dependency of the respective elements, VTE, VTD, |VTD|, $(gmD/gmE)^{1/2}\cdot|VTD|$ which construct the equation (5). As illustrated in FIG. 9, the threshold voltages VTE and VTD both become characteristics each having an approximate primary temperature coefficient negative with respect to the temperature. Since |VTD| is the absolute value of VTD, it becomes a characteristic having a positive approximate primary temperature coefficient larger than 0, which is obtained by vertically inverting VTD. The second term of the equation (5) $(gmD/gmE)^{1/2}\cdot|VTD|$ becomes a characteristic in which the inclination of |VTD| changes according to $(gmD/gmE)^{1/2}$. The equation (5) can be considered to be one obtained by adding together the temperature dependency of the first and second terms. When changes in VTE and VTD with respect to a rise in temperature are equal to each other, the sum of the absolute values |VTD| of VTD and VTE does not depend on the temperature. When $(gmD/gmE)^{1/2}$ is 1, the approximate primary temperature coefficient of Vref also becomes zero. Further, even though the negative approximate primary temperature coefficients of VTE and VTD are different from each other, it is possible to adjust the inclination of $(gmD/gmE)^{1/2}\cdot|VTD|$ with respect to the temperature by parameters included in gmD/gmE of the equation (5) and thereby set the approximate primary temperature coefficient of Vref to zero (however where the temperature dependency of gmD/gmE is ignored).

However, in fact, VTE and VTD are not made linear due to the influence of the minority carriers relative to the temperature and the influence of the extension of the depletion layer or the like, and the temperature dependency cannot be approximated by the linear equation. In addition, since the behaviors of VTE and VTD with respect to the temperature differ, Vref given by the equation (5) also becomes a curve which can be approximated by a secondary temperature coefficient a, a primary temperature coefficient b, and a constant c such as expressed in the following equation (5)' with respect to a temperature T.

$$Vref=aT^2+bT+c \quad (5)'$$

Figure 10:
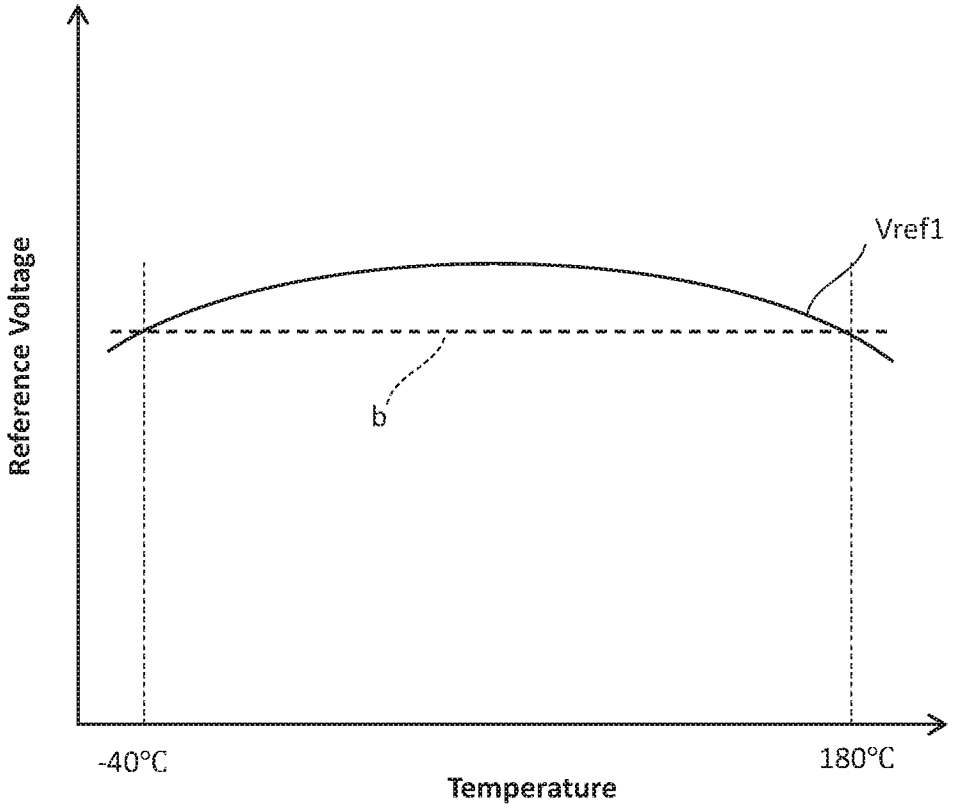
FIG.10 Prior Art
FIG. 10 is a diagram illustrating temperature dependency in the related art.

Here, as illustrated in FIG. 10, even though the parameters included in gmD/gmE are adjusted to set the approximate primary temperature coefficient b to zero, the secondary term cannot be cancelled, and Vref becomes a temperature characteristic curve in which a convex shape is made on the upper side.

In the first embodiment, in order to reduce the temperature dependency in the range from −40° C. to LCET, gmD/gmE is adjusted in such a manner that the approximate primary temperature coefficient b of Vref1 over the entire operating temperature range of −40° C. to 180° C. in FIG. 10 becomes a minus value. Further, the amount of a fluctuation of Vref1 is minimized in the temperature range from −40° C. to LCET. For example, specifically, x in the following equation (7) is assumed to be a value smaller than 1. However, when the value of x becomes 0.7 or smaller, a negative inclination becomes extremely large even though the temperature ranges from −40° C. to LCET, so that the amount of the fluctuation of Vref between −40° C. and LCET cannot be minimized. It is thus desirable that the value of x exceeds 0.7.

$$gmD/gmE<x \quad (7)$$

Further, since gm in the equation (7) is expressed by the following equation (8) by using a channel mobility μ, a gate insulation film capacity Cox, a channel width W, and a channel length L, gm can be adjusted by W and/or L while considering μ and Cox which vary depending on a production process:

$$gm=\mu Cox\cdot W/L \quad (8)$$

For example, when W/L is assumed to be a channel size ratio, a channel size ratio of a depletion type NMOS transistor is adjusted by a value smaller than one times of a channel size ratio of an enhancement NMOS transistor and exceeding 0.7 times the channel size ratio thereof. Next, a description will first be made about operation where the temperature becomes a high temperature higher than or equal to LCET, on the basis of the related art reference voltage generator.

Figure 11A:
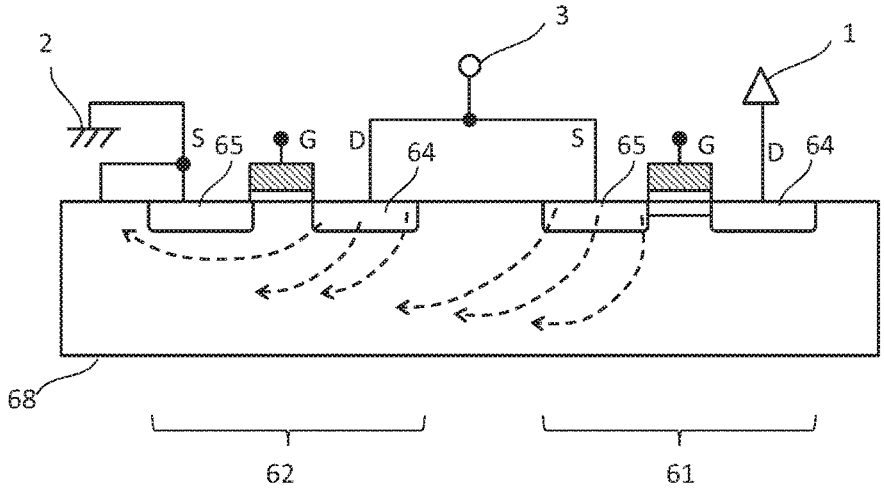
FIG.11A Prior Art
FIG. 11A is a typical sectional view illustrating the reference voltage generator in a P-type semiconductor substrate according to the related art and FIG. 11B is a typical sectional view illustrating the reference voltage generator in a N-type semiconductor substrate according to the related art.

FIG. 11A is a typical sectional view where a depletion type NMOS transistor 61 and an enhancement type NMOS transistor 62 are fabricated in the same P-type semiconductor substrate 68, and their backgates are connected to the same ground terminal 2. Although there are parts omitted in terms of connections of terminals of respective elements, they are assumed to be connected so as to construct such a related art reference voltage generator as illustrated in FIG. 8.

At the temperature higher than or equal to LCET, such PN-junction leak currents as indicated by dotted lines, of parasitic diodes existing between an N-type source region 65 of the depletion type NMOS transistor 61 and the P-type semiconductor substrate 68 and between an N-type drain region 64 of the enhancement type NMOS transistor 62 and the P-type semiconductor substrate 68 become remarkable. Accordingly, not all the constant current supplied from the depletion type NMOS transistor 61 does not flow through the enhancement type NMOS transistor 62, so that a reference voltage generated from a reference voltage terminal 3 lowers. That is why Vref2 indicated by the one-dot chain line in FIG. 2 abruptly lowers at the temperature higher than or equal to LCET. Here, a similar PN-junction leak current flows even into a drain of the depletion type NMOS transistor 61, but does not affect the constant current supplied from the depletion type NMOS transistor.

Figure 3:
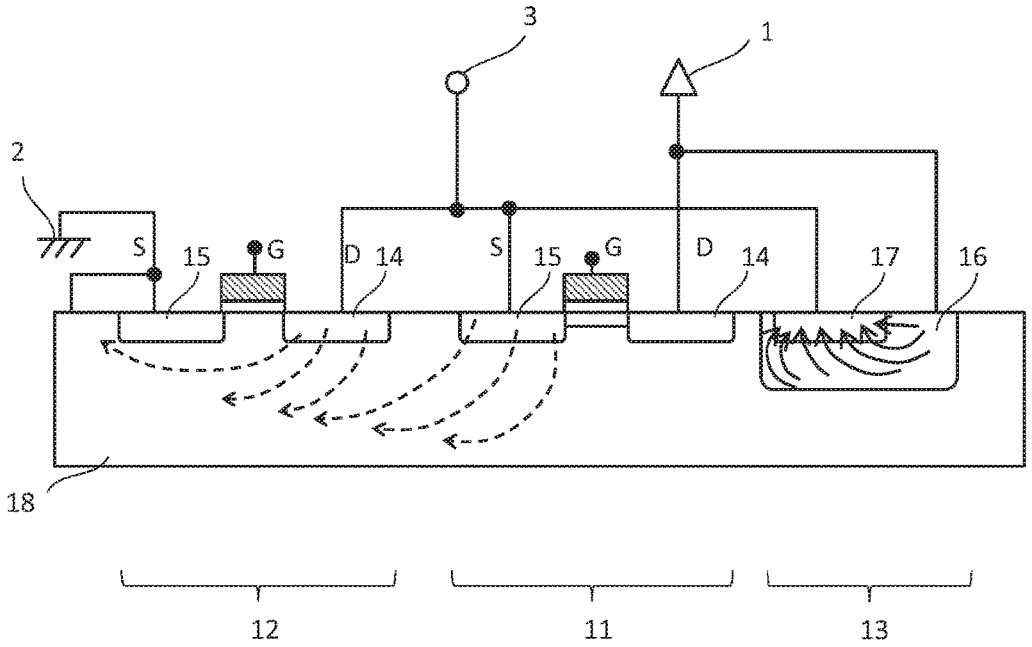
FIG. 3 is a sectional view illustrating the reference voltage generator according to the first embodiment.

FIG. 3 is a sectional view illustrating the structure of the reference voltage generator 100 according to the first embodiment in which a depletion type NMOS transistor 11 constructing the first constant current circuit 101, a current adjusting diode 13 constructing the second constant current circuit, and an enhancement type NMOS transistor 12 constructing the voltage generation circuit 103 are shown. The N-type drain region 14 of the depletion type NMOS transistor 11 is connected to the power supply terminal 1, and the N-type source region 15 is connected to the reference voltage terminal 3. The N-type drain region 14 of the enhancement type NMOS transistor 12 is connected to the reference voltage terminal 3, and the N-type source region 15 is connected to the ground terminal 2. Further the N-type well region 16 is connected to the power supply terminal 1, and the P-type low-concentration region 17 is connected to the reference voltage terminal 3. Electrical connections of other terminals are omitted in order to give easy understanding of the current flow.

On the contrary to the related art, in the first embodiment, as illustrated in FIG. 3, a current adjusting diode 13 is provided between the power supply terminal 1 and the reference voltage terminal 3 to make the circuit configuration of FIG. 1 to thereby suppress the abrupt reduction in the reference voltage at a temperature higher than or equal to LCET. The current adjusting diode 13 is constructed to provide an N-type well region 16 and a P-type low concentration region 17 within a P-type semiconductor substrate 18, connect the N-type well region 16 to a power supply terminal 1 and connect the P-type low concentration region 17 to a reference voltage terminal 3.

A reverse saturation current IS (solid arrows) flowing through the current adjusting diode 13 is set so as to be larger than or equal to PN junction leak currents indicated by dotted arrows, which are generated by parasitic diodes lying between an N-type source region 15 of a depletion type NMOS transistor 11 and the P-type semiconductor substrate 18 and between an N-type drain region 14 of an enhancement type NMOS transistor 12 and the P-type semiconductor substrate 18. Since the currents both follow the equation (3) where a PN junction area configuring a current adjusting diode and a PN junction area of each parasitic diode are the same, for example, minority carriers in the P-type low concentration region 17 and the N-type well region 16 are adjusted and set to flow a lot into the current adjusting diode. A more realistic determination method is that Vf (forward voltage at the time that the forward current is 1 μA or the like, for example) of the current adjusting diode is adjusted to be smaller than Vf of the parasitic diode in accordance with the equation (2) correlated to the equation (3) related to the reverse saturation current. Further, when it is difficult to adjust Vf, the PN junction area of the current adjusting diode is set to be larger than the PN junction area of the parasitic diode, and the reverse saturation current IS is adjusted to be larger than the PN-junction leak current ISp.

As described above, the depletion type NMOS transistor and the enhancement type NMOS transistor are constructed to almost determine Vref at the temperature lower than or equal to LCET. gmD/gmE are adjusted so as to relax nonlinearity only in its temperature range to minimize a fluctuation in the reference voltage. Further, there is provided such a configuration that Vref is almost determined by gmE of the enhancement type NMOS transistor and the reverse saturation currents of the current adjusting diode and the PN-junction leak currents of the parasitic diodes at the temperature higher than or equal to LCET. A reduction in Vref is suppressed by causing the current adjusting diode to generate the current larger than the PN junction leak current of the parasitic diode. By doing like this, it is possible to suppress the fluctuation in the reference voltage in the entire operating temperature range.

Although the first embodiment is constructed to input the current of the first constant current circuit and the current of the second constant current circuit to the voltage generation circuit, it is needless to say that various changes can be made within the scope not departing from the gist of the first embodiment.

For example, when it is difficult for the current adjusting diode to ensure the current larger than the PN-junction leak current of the parasitic diode, the current adjusting diode may be replaced by a Schottky junction diode formed by junction of a semiconductor with a metal. For example, when an AL metal is directly connected to the N-type well region 16 of FIG. 3, Vf which is about half of that of the PN junction diode can be obtained by a decrease in potential barrier on a junction surface. Further, as the reverse saturation current, a current having a level from a few 10 nA to a few 100 nA can easily be obtained at normal temperature.

Figure 4:
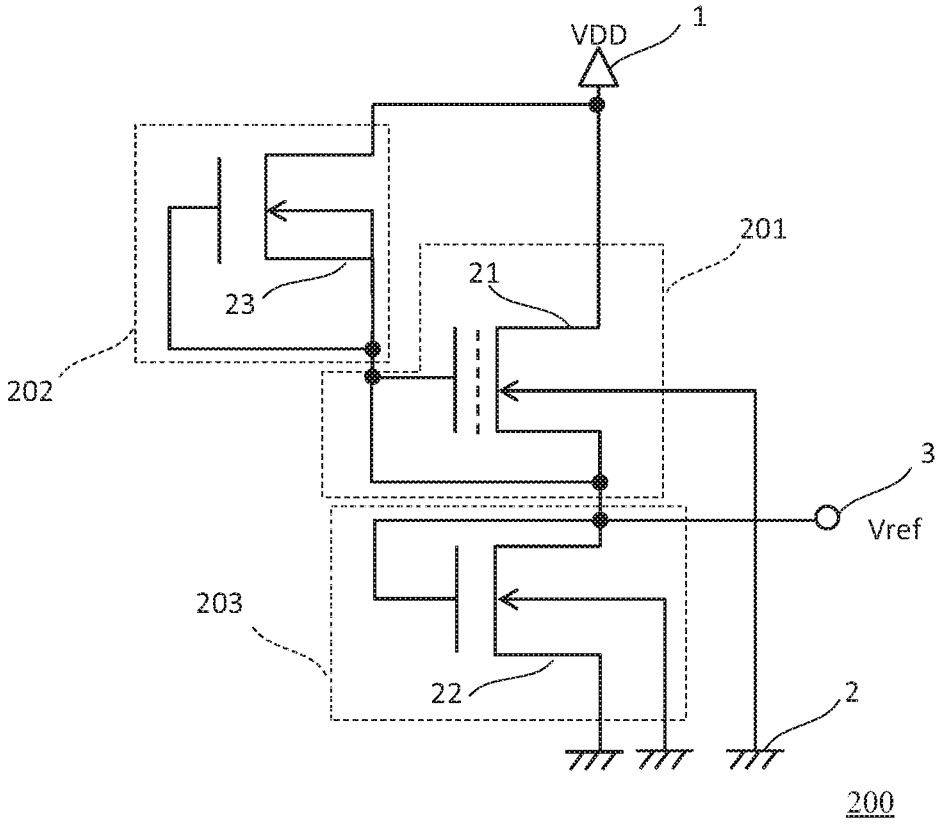
FIG. 4 is another circuit diagram illustrating the reference voltage generator according to the first embodiment.

Further, a subthreshold current of a MOS transistor may be utilized as a constant current instead of the current adjusting diode. In FIG. 4 the reference voltage generator 200 includes the first constant current circuit 201 constructed from the depletion type NMOS transistor 21, the second constant current circuit 202 constructed from the current adjusting enhancement type NMOS transistor 23, and the voltage generating circuit 203 constructed from the enhancement type NMOS transistor 22. Moreover in FIG. 4 a current adjusting enhancement type NMOS transistor 23 whose gate and source are connected, in the second constant current circuit 202 as an alternative to the current adjusting diode 13 in FIG. 1. For example, when a drain current at the threshold voltage of the current adjusting enhancement type NMOS transistor 23 is adjusted by a channel length and a channel width, a subthreshold current where the gate and source are connected (where a gate-to-source voltage is 0V) can be predicted from the following equation (9). Here, k is a Boltzmann constant, T is a temperature, q is an electron charge, Cox is a gate insulation film capacity, and Cd is a depletion layer capacity, S is a subthreshold coefficient.

An advantage of the current adjusting enhancement type NMOS transistor 23 over the diode can easily be achieved by increasing the current to thereby shorten the channel length. It is thus possible to reduce a chip area as compared with the case where the reverse saturation current IS increases with a PN junction area as in the diode.

$$S=\ln 10\cdot kT/q\cdot(1+Cd/Cox) \quad (9)$$

Also, in FIG. 4, a PMOS whose gate is turned off may be utilized instead of the current adjusting enhancement type NMOS transistor 23.

Further, when the subthreshold current of the MOS transistor is used for current adjustment, it is needless to say that in addition to the shortening of the channel length, the threshold voltage may be reduced, or the W length may be made large.

Figure 5:
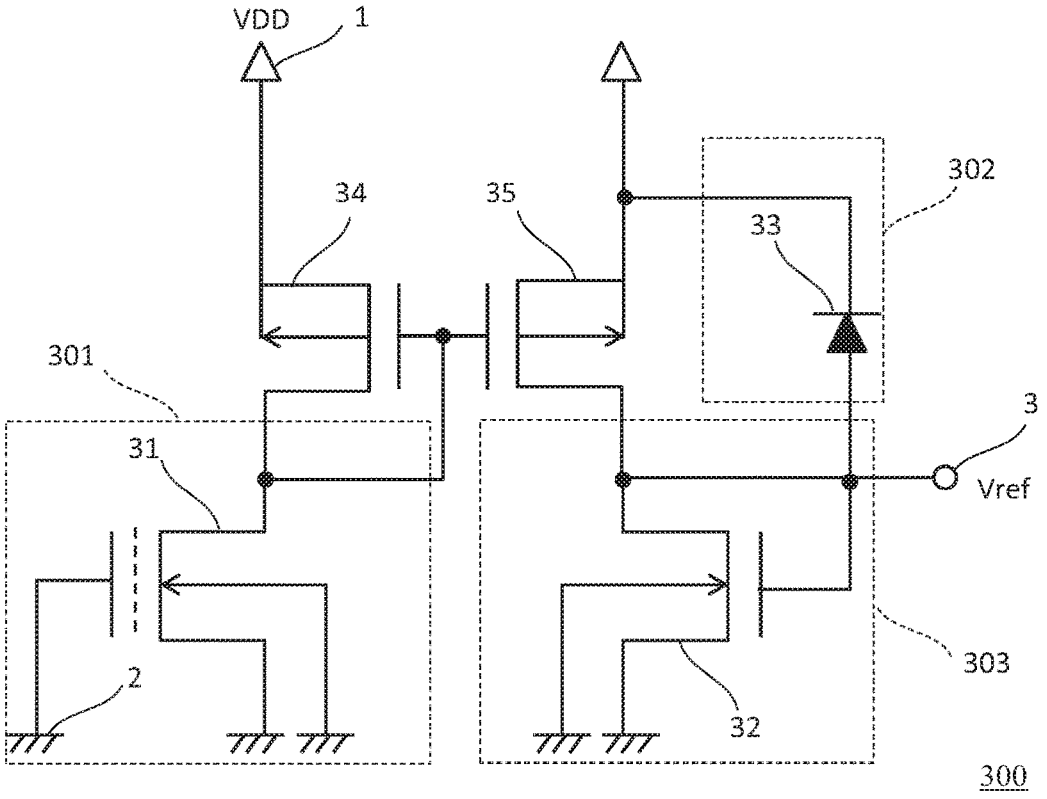
FIG. 5 is a further circuit diagram illustrating the reference voltage generator according to the first embodiment.

Furthermore, the circuit configuration of the first embodiment may be set as illustrated in FIG. 5. In the reference voltage generator 300 in FIG. 5, a current of a depletion type NMOS transistor 31 of a first constant current circuit 301 is delivered to an enhancement type NMOS transistor 32 of a voltage generation circuit 303 through a current mirror circuit constructed by a first PMOS transistor 34 and a second PMOS transistor 35. Further, FIG. 5 is similar to FIG. 1 in that the current of the first constant current circuit 301 and a current of a second constant current circuit 302 which is constructed from the current adjusting diode 33 are supplied to the voltage generation circuit 303 to generate a reference voltage Vref at a reference voltage terminal 3. In the circuit configuration of FIG. 5, a source and a backgate of the depletion type NMOS transistor 31 which constructs the first constant current circuit 301 are connected to a ground terminal 2. By making the source and the backgate to be the same potential in this manner, such PN-junction leak current as generated at the source of the depletion type NMOS transistor 11 illustrated in FIG. 3 can be reduced. The constant current of the second constant current circuit 302 may thus be made to correspond only to the PN-junction leak current generated at a drain of the enhancement type NMOS transistor 32 which constructs the voltage generation circuit 303. A chip area can be reduced by making a PN junction area small.

Although not illustrated in particular here, the current adjusting diode may be formed within a drain region of the second PMOS transistor 35. In this case, since there is no need to form an element isolation region and the like as compared with the case where the current adjusting diode is added separately, a more reduction in the chip area can be achieved.

Also, although not illustrated in particular, a similar effect may be obtained by causing a parasitic diode existing within an IC to adjoin the drain of the enhancement type NMOS transistor without directly adding the current adjusting diode to within the circuit. In this case, since there is no need to increase a circuit scale, the chip can be fabricated in a smaller area.

Further, in the case of the present configuration, since the diode having a large reverse saturation current IS is preferably utilized to reduce the area of the current adjusting diode, a junction at a low concentration is desirable. A low-concentration N-type well region may be formed exclusively as one of forming methods.

Figure 6:
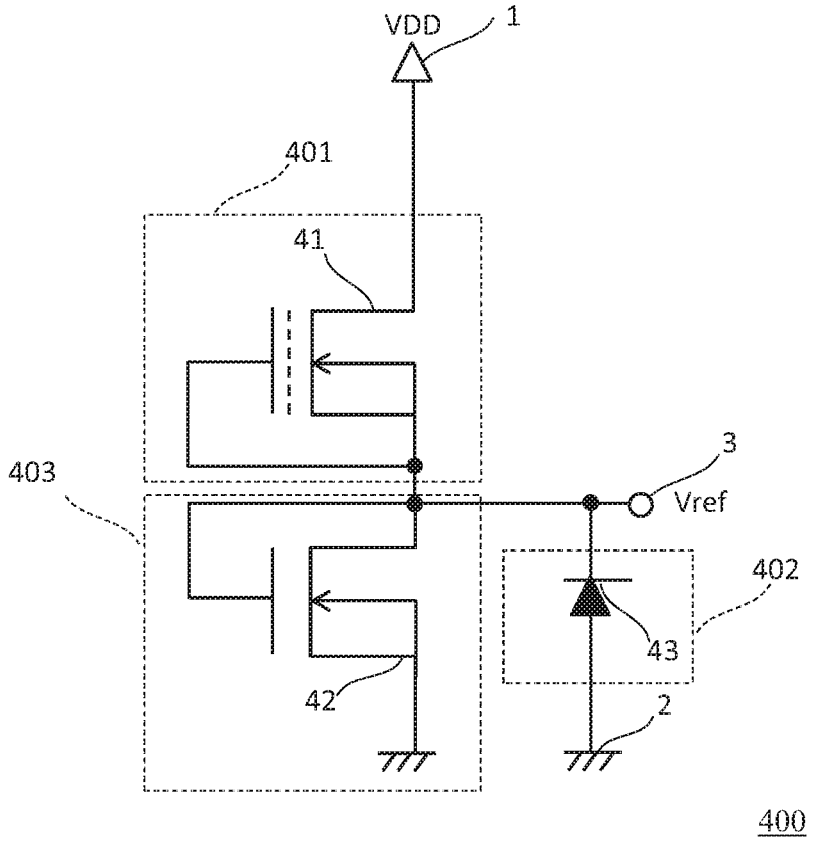
FIG. 6 is a circuit diagram illustrating a reference voltage generator according to a second embodiment of the present invention.

FIG. 6 is a circuit diagram illustrating a reference voltage generator 400 according to a second embodiment of the present invention. The reference voltage generator 400 according to the second embodiment is equipped with a first constant current circuit 401, a second constant current circuit 402, and a voltage generation circuit 403. The reference voltage generator 400 is a device in which these circuits are formed in an N-type semiconductor substrate as will be described later.

The first constant current circuit 401 connected to a power supply terminal 1 and supplied with a power supply voltage VDD outputs a first constant current which does not depend on VDD to the voltage generation circuit 403. Further, the second constant current circuit 402 connected between a reference voltage terminal 3 and a ground terminal 2 outputs a second constant current which does not depend on a reference voltage to the ground terminal 2. The voltage generation circuit 403 provided with a current obtained by subtracting the second constant current from the first constant current outputs a reference voltage Vref based on the first constant current and the second constant current to the reference voltage terminal 3.

In the second embodiment, the first constant current circuit 401 is constructed from a depletion type NMOS transistor 41. The depletion type NMOS transistor 41 has a gate, a source, and a backgate connected to the reference voltage terminal 3, and a drain connected to the power supply terminal 1. The second constant current circuit 402 is constructed from a current adjusting diode 43 which utilizes a PN junction. The current adjusting diode 43 has an anode connected to the ground terminal 2, and a cathode connected to the reference voltage terminal 3. The voltage generation circuit 403 is constructed from an enhancement type NMOS transistor 42. The enhancement type NMOS transistor 42 has a gate and a drain connected to the reference voltage terminal 3, and a source and a backgate connected to the ground terminal 2.

A description will next be made about circuit operations of the reference voltage generator 400 of FIG. 6. The depletion type NMOS transistor 41 which constructs the first constant current circuit 401 outputs a current based on the equation (1) from it source in a manner similar to the first embodiment.

The current adjusting diode 43 constructed from the PN junction diode, which constructs the second constant current circuit 402, outputs the reverse saturation current IS having the second threshold voltage Vf given by the equation (2), and expressed in the equation (3) from the cathode to the anode. Here, the second embodiment is similar to the first embodiment in that when Vf is high, IS becomes low, whereas when Vf is low, IS becomes high.

A current which flows through the enhancement type NMOS transistor 42 configuring the voltage generation circuit 403 becomes a current analogous to the forward characteristic of the diode relative to the reference voltage Vref, based on the equation (4).

Even in the second embodiment, the reference voltage Vref thus substantially indicates a characteristic expressed by the equation (5) in which the influence of the reverse saturation current IS can be ignored at the temperature lower than or equal to LCET. Further, the influence of both the PN-junction leak current of the parasitic diode, which exponentially increases with a rise in temperature, and the reverse saturation current IS of the current adjusting diode becomes remarkable at the temperature higher than or equal to LCET. Hence, a Vref component expressed in an equation (10) is added to the equation (5). Here, ISp is the PN-junction leak current of the parasitic diode.

$$Vref=VTE+\{2ISp-IS\}/gmE)^{1/2} \quad (10)$$

Figure 12:
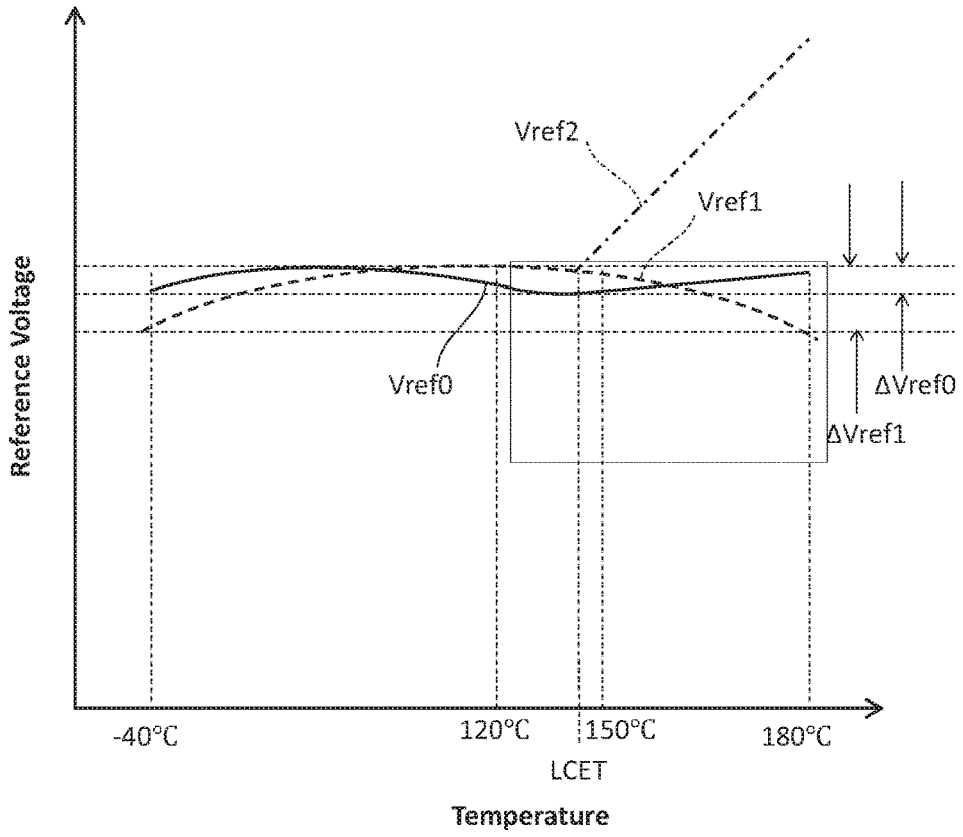
FIG. 12 is a diagram illustrating temperature dependency of a reference voltage supplied by the reference voltage generator according to the second embodiment.

FIG. 12 is a graph illustrating temperature dependency of a reference voltage Vref in the second embodiment where an entire operating temperature range is set from −40° C. to 180° C. In FIG. 12, a reference voltage Vref0 in the second embodiment, which is indicated by a solid line extending from −40° C. to the vicinity of LCET is set by adjusting gmD/gmE, based on the equation (5). This is an adjusting method similar to that in the first embodiment. That is, gmD/gmE is adjusted in such a manner that the amount of a fluctuation in the reference voltage is minimized between −40° C. and LCET with respect to such a conventional Vref1 that the approximate primary temperature coefficient becomes zero between −40° C. and 180° C.

On the other hand, the reference voltage Vref0 indicated by the solid line at the temperature higher than or equal to LCET becomes a characteristic based on the equation (10). Here, the e suppression of the abrupt voltage rise like Vref2 is achieved by causing part of the PN-junction leak current of the parasitic diode which flows into the voltage generation circuit 403 to divide and escape to the current adjusting diode 43. By taking such a configuration, a fluctuation in the reference voltage can be suppressed as compared with the related art even in the second embodiment using the N-type semiconductor substrate.

The behavior of the reference voltage at higher temperature than or equal to LCET at this time will be described on the basis of the related art reference voltage generator.

Figure 11B:
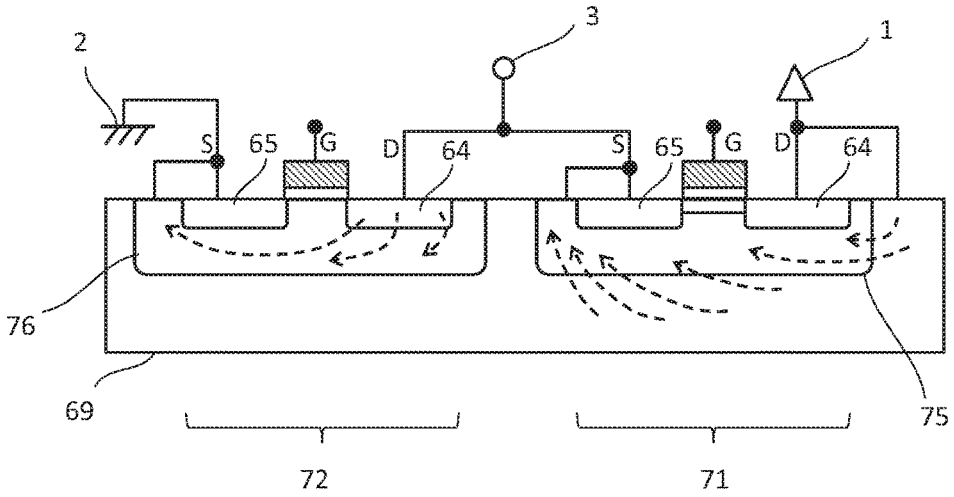
FIG.11B Prior Art

FIG. 11B is a typical sectional view where a depletion type NMOS transistor 71 and an enhancement type NMOS transistor 72 are respectively fabricated in a first P-type well region 75 and a second P-type well region 76 of the same N-type semiconductor substrate 69, and their backgates are connected to the respective P-type well regions. Although there are parts omitted in terms of connections of terminals of respective elements, they are assumed to be connected so as to construct such a related art reference voltage generator as illustrated in FIG. 8.

The N-type semiconductor substrate 69 is connected to a power supply terminal 1 which supplies the highest potential. Accordingly, the PN-junction leak current flows into a reference voltage terminal 3 as indicated by dotted lines through a parasitic diode formed between the N-type semiconductor substrate 69 and the first P-type well region 75. On the other hand, the related art in FIG. 11B is similar to the related art in FIG. 11A in that the PN junction leak current flows from the reference voltage terminal 3 to a ground terminal 2 through a parasitic diode formed between an N-type drain region 64 of the enhancement type NMOS transistor 72 and the second P-type well region 76. However, minority carriers are much generated in the parasitic diode formed between the N-type semiconductor substrate 69 and the first P-type well region 75 being a PN junction diode having a lower concentration impurity, based on the equation (3), so that the PN-junction leak current increases. The difference between these PN-junction leak currents flows into the enhancement type NMOS transistor 72 which constructs the voltage generation circuit 403, and hence the reference voltage rises at the temperature higher than or equal to LCET as shown by an abrupt rise in Vref2 indicated by a one-dot chain line of FIG. 12 at the temperature higher than or equal to LCET.

Figure 7:
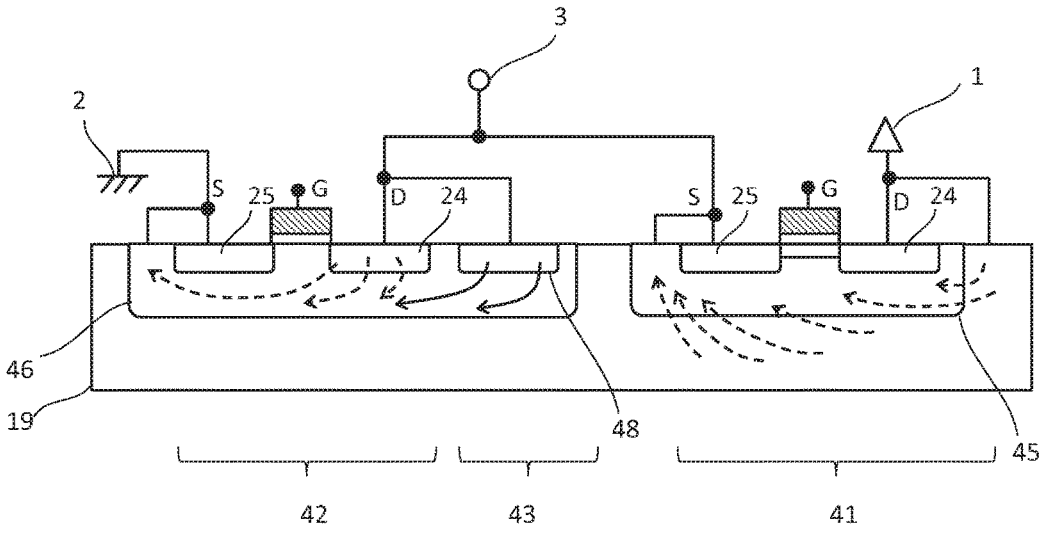
FIG. 7 is a typical sectional view illustrating the reference voltage generator according to the second embodiment.

FIG. 7 is a sectional view illustrating the structure of the reference voltage generator 400 according to the second embodiment in which a depletion type NMOS transistor 41 constructing the first constant current circuit 401, a current adjusting diode 43 constructing the second constant current circuit, and an enhancement type NMOS transistor 42 constructing the voltage generation circuit 403 are shown. The N-type drain region 24 of the depletion type NMOS transistor 41 formed in the first P-type well region 45 of the N-type semiconductor substrate 19 is connected to the power supply terminal 1, and the N-type source region 25 is connected to the reference voltage terminal 3. The N-type drain region 24 of the enhancement type NMOS transistor 42 formed in the second P-type well region 46 is connected to the reference voltage terminal 3, and the N-type source region 25 is connected to the ground terminal 2. Further the current adjusting diode 43 is formed in the second P-type well region 46 connected to the ground terminal, and the N-type low concentration region 48 is connected to the reference voltage terminal 3. Electrical connections of other terminals are omitted in order to give easy understanding of the current flow.

In the second embodiment, in order to suppress such rise in the reference voltage at the temperature higher than or equal to LCET, the current adjusting diode 43 is provided between the reference voltage terminal 3 and the ground terminal 2 to form the circuit configuration of FIG. 6 as illustrated in FIG. 7. In the current adjusting diode 43 the N-type low concentration region 48 is the cathode and the second P-type well region 46 is the anode.

A reverse saturation current IS (solid arrows) flowing through the current adjusting diode 43 is set based on the equation (10) so as to be smaller than the difference between the PN junction leak current flowing from an N-type semiconductor substrate 19 to a first P-type well region 45 and the PN-junction leak current flowing from an N-type drain region 24 of an enhancement type NMOS transistor 42 to the second P-type well region 46, both of which are indicated by dotted arrows in FIG. 7. In so doing a reduction in reference voltage component at the temperature higher than or equal to LCET based on the equation (5) is compensated, thereby to suppress a fluctuation in the reference voltage. ISp, IS, Vf in the equation (10), and a current setting method using a PN junction area are similar to those in the first embodiment.

Even in the second embodiment as described above, Vref is constructed to be almost determined by the depletion type MOS transistor and the enhancement MOS transistor at the temperature lower than or equal to LCET. The ratio gmD/gmE is adjusted so as to relax nonlinearity only in this temperature range to minimize the fluctuation in the reference voltage. Further, at the temperature higher than or equal to LCET, Vref is constructed to be almost determined by gmE of the enhancement type MOS transistor and the reverse saturation currents of the current adjusting diode and the PN-junction leak current of the parasitic diode. In the current adjusting diode the current smaller than the PN-junction leak current of the parasitic diode is generated to thereby suppress the reduction in Vref. In so doing the fluctuation in the reference voltage can be suppressed in the entire operating temperature range.

In the embodiments described so far, it is common that the gate electrodes of the depletion type NMOS transistor and the enhancement type NMOS transistor configuring the reference voltage generator are respectively constructed as an N type. The enhancement type NMOS transistor may however be formed by being constructed as the same channel profile as the depletion type NMOS transistor and configuring its gate electrode as a P type. Doing so makes it possible to cancel variations in channel profile and generate a more stable reference voltage.

Also, in the embodiments described so far, the reference voltage terminal is constructed as the terminal connecting the gate and drain of the N-type enhancement type NMOS transistor, but can be applied even to the case where another circuit such as to cause the gate of the enhancement type NMOS transistor to assume the reference voltage is added. Further, although each circuit element of the reference voltage generator described so far is described using NMOS, the present invention can similarly be applied by reversing a conductivity type of each region even in the case of PMOS.

What is claimed is:

1. A reference voltage generator, comprising:

a first constant current circuit configured to output a first constant current with respect to an input voltage;

a second constant current circuit configured to output a second constant current with respect to the input voltage; and a voltage generation circuit configured to generate and supply a reference voltage, wherein the reference voltage is based on a sum of a first reference voltage component based on the first constant current and a second reference voltage component based on the second constant current.

2. The reference voltage generator according to claim 1;

wherein the first constant current circuit has a first threshold voltage whose value decreases with respect to a rise in temperature, wherein the voltage generation circuit has a second threshold voltage whose value decreases with respect to a rise in temperature, wherein a first reference voltage component is generated based on the first threshold voltage and the second threshold voltage, and has a negative primary coefficient in an entire operating temperature range, wherein a second reference voltage component is generated based on the second constant current and the second threshold voltage, and has a positive primary coefficient in a second temperature range, which is a high temperature region and included in the entire operating temperature range, and wherein the reference voltage is based on a sum of the first reference voltage component and the second reference voltage component.

3. The reference voltage generator according to claim 2, wherein the first constant current circuit comprises a depletion type MOS transistor having a gate and a source electrically connected to each other and supplying the first constant current from the source based on a voltage applied to a drain thereof.

4. The reference voltage generator according to claim 2, wherein the voltage generation circuit comprises a first enhancement type MOS transistor having a gate and a drain electrically connected to each other, and generating a voltage at the drain from a current applied to the drain.

5. The reference voltage generator according to claim 2, wherein the second constant current circuit comprises a PN junction diode that outputs the second constant current from an anode thereof, based on a voltage applied to a cathode thereof.

6. The reference voltage generator according to claim 2, wherein the second constant current circuit comprises a second enhancement type MOS transistor having a gate and a source electrically connected to each other and supplying the second constant current from the source based on a voltage applied to a drain thereof.

7. The reference voltage generator according to claim 4;

wherein the reference voltage generator is in a P-type semiconductor substrate, and wherein the second constant current is a current larger than a leakage current generated by a parasitic diode comprised of the drain of the first enhancement type MOS transistor and the P-type semiconductor substrate.

8. The reference voltage generator according to claim 2;

wherein the reference voltage generator is in an N-type semiconductor substrate, wherein the first constant current circuit is within a first P-type well region in the N-type semiconductor substrate, wherein the second constant current circuit and the voltage generation circuit are within a second P-type well region in the N-type semiconductor substrate, and wherein the second constant current is a current smaller than a leak current generated by a parasitic diode comprised of the first P-type well region and the N-type semiconductor substrate.

9. The reference voltage generator according to claim 3;

wherein the reference voltage generator is in an N-type semiconductor substrate, wherein the first constant current circuit is within a first P-type well region in the N-type semiconductor substrate, wherein the second constant current circuit and the voltage generation circuit are formed within a second P-type well region in the N-type semiconductor substrate, and wherein the second constant current is a current smaller than a leak current generated by a parasitic diode comprised of the first P-type well region and the N-type semiconductor substrate.

10. The reference voltage generator according to claim 4;

wherein the reference voltage generator is in an N-type semiconductor substrate, wherein the first constant current circuit is within a first P-type well region in the N-type semiconductor substrate, wherein the second constant current circuit and the voltage generation circuit are formed within a second P-type well region in the N-type semiconductor substrate, and wherein the second constant current is a current smaller than a leak current generated by a parasitic diode comprised of the first P-type well region and the N-type semiconductor substrate.

11. The reference voltage generator according to claim 5;

wherein the reference voltage generator is in an N-type semiconductor substrate, wherein the first constant current circuit is within a first P-type well region in the N-type semiconductor substrate, wherein the second constant current circuit and the voltage generation circuit are within a second P-type well region in the N-type semiconductor substrate, and wherein the second constant current is a current smaller than a leak current generated by a parasitic diode comprised of the first P-type well region and the N-type semiconductor substrate.

12. The reference voltage generator according to claim 6;

wherein the reference voltage generator is in an N-type semiconductor substrate, wherein the first constant current circuit is within a first P-type well region in the N-type semiconductor substrate, wherein the second constant current circuit and the voltage generation circuit are within a second P-type well region in the N-type semiconductor substrate, and wherein the second constant current is a current smaller than a leak current generated by a parasitic diode comprised of the first P-type well region and the N-type semiconductor substrate.

* * * * *